United States Patent [19]

Holten

[11] Patent Number: 5,003,215

[45] Date of Patent: Mar. 26, 1991

[54] REFLECTIVE ELECTRIC INCANDESCENT LAMP FOR PRODUCING HIGH INTENSITY BEAM

[75] Inventor: Petrus A. J. Holten, Weert, Netherlands

[73] Assignee: U.S. Philips Corporation, New York, N.Y.

[21] Appl. No.: 384,580

[22] Filed: Jul. 24, 1989

[30] Foreign Application Priority Data

Aug. 5, 1988 [NL] Netherlands ..... 8801958

[51] Int. Cl.[5] ..... H01K 1/32

[52] U.S. Cl. ..... 313/113; 313/114; 313/115

[58] Field of Search ..... 313/113, 114, 115, 315, 313/341, 578, 317

[56] References Cited

U.S. PATENT DOCUMENTS

| | | | |
|---|---|---|---|
| 2,218,346 | 10/1940 | Spaeth | 313/315 |
| 4,317,060 | 2/1982 | Fitzgerald | 313/113 |
| 4,803,394 | 2/1989 | Holten | 313/114 |

FOREIGN PATENT DOCUMENTS 1147918 12/1957 France .

*Primary Examiner*—Donald J. Yusko
*Assistant Examiner*—Diab Hanadi
*Attorney, Agent, or Firm*—Robert J. Kraus

[57] ABSTRACT

The electric incandescent lamp according to the invention has a lamp vessel (1) comprising a second wall portion (6) opposite to a neck-shaped first wall portion (4). Between the largest diameter (3) and the second wall portion (6) is disposed a third mirror-coated wall portion (7,7'), which is mainly curved in axial section along the arc of a circle, whose center (8,8') is located on the other side of the axis of symmetry (2) and of a plane passing through the largest diameter (3). The filament (10) has a plane of symmetry passing through the axis of symmetry (2) and extends on either side of a second plane through said axis at right angles to the first plane. The lamp produces together with an external reflector a narrow beam with a high luminous flux at the center thereof.

3 Claims, 1 Drawing Sheet

REFLECTIVE ELECTRIC INCANDESCENT LAMP FOR PRODUCING HIGH INTENSITY BEAM

BACKGROUND OF THE INVENTION

The invention relates to an incandescent lamp comprising:

- a rotation-symmetrical blown lamp vessel sealed in a vacuum tight manner and provided with:
- an axis of symmetry;
- a largest diameter transverse to the axis of symmetry;
- a neck-shaped first wall portion having a free end;
- a second wall portion opposite to the neck-shaped wall portion;
- a third mirror-coated inner concave wall portion between the first wall portion and the largest diameter, which wall portion is mainly curved in axial section along the arc of a circle, whose centre of curvature is located on a circle;
- a fourth translucent wall portion between the neck-shaped wall portion and the largest diameter;
- a filament arranged around the axis of symmetry substantially in a plane transverse to said axis, substantially at the largest diameter;
- current supply conductors extending from the filament to contact on a lamp cap connected to the free end of the neck-shaped wall portion.

Such a lamp is known from FR-1 147 918.

Lamps of this kind are designated as bowl mirror lamps. They are intended to be used in an external parabolic reflector, which is in opposition to the mirror-coated wall portion of the lamp. Light, which is generated by the filament and is incident upon the mirror-coated wall portion, is thrown by said wall portion on the parabolic reflector. The reflector concentrates this light and the light which is directly incident from the filament upon the reflector.

In bowl mirror lamps commercially available, the mirror-coated wall portion is spherical. The central part of the mirror-coated wall portion in the immediate proximity of the axis of symmetry may be conical or may not be mirror-coated, however. If the central part is spherical and mirror-coated, the light incident upon it is reflected for the major part to the neck-shaped wall portion and is lost therein. If the central part is not mirror-coated, the incident light is added to the beam formed by the reflector. If the central part is not spherical, but, for example, conical and mirror-coated, incident light is reflected at least in part to the reflector.

In the bowl mirror lamps commercially available, the filament is arranged in a trapezoidal form with open base on one side of a plane passing through the axis of symmetry. This eccentric arrangement of the filament is necessary to prevent that the mirror-coated wall portion produces an image of the filament which falls over the filament. Otherwise, the filament would locally assume a considerably higher temperature, as a result of which the life of the lamp would be shortened.

The eccentric arrangement of the filament has the consequence that all portions (the elements) of the filament are located at a comparatively large distance from the axis of symmetry and hence also at a comparatively large distance from the focus of the reflector, which must be located on the axis of symmetry of the lamp vessel. The light beam formed by the reflector consequently has comparatively low intensity at its centre and is comparatively wide. The beam is also not very homogeneous, which in the case of projection on a screen becomes manifest in a central dark spot.

The object of the lamp according to the aforementioned FR-1 147 918 is to provide a light source, which with a reflector produces a better beam. For this purpose, the third wall portion is curved in axial section along the arc of a circle, whose radius is about $\frac{1}{4}$ of the largest diameter of the lamp vessel. The centre of curvature is therefore located together with the associated arc of a circle on the same side of the axis of symmetry. The relevant wall portion can be described as the body of revolution obtained by revolving the arc of a circle about the axis of symmetry. An imaginary circle is then obtained around said axis, on which the centres of curvature are located. The filament is arranged like a crown around said axis and through the centres of curvature. However, it has been found that this lamp does not permit of producing a much better light beam than the lamp commercially available.

SUMMARY OF THE INVENTION

The invention has inter alia for its object to provide a lamp of the kind described in the opening paragraph, which is capable of producing together with an external reflector a narrow light beam having a high intensity at the centre thereof.

According to the invention, this object is achieved in that the centre of curvature and the associated arc of the third mirror-coated wall portion are located on opposite sides of the axis of symmetry and of a plane passing through the largest diameter, and the filament has a plane of symmetry at least substantially coinciding with a first plane through the axis of symmetry, while the filament extends on either side of a second plane through said axis at right angles to the first plane.

Due to the location of the centres of curvature, no sharply defined image of the filament is formed by the third mirror-coated inner concave wall portion on the filament. The filament is enveloped only in a diffuse "cloud" of reflected radiation so that it retains a normal temperature profile and the lamp retains a normal life. The location of the centres of curvature allows for the more central position of the filament, now extending on either side of the second plane through the axis. The filament is thus situated in closer proximity of the axis of symmetry and hence of the focus of an external reflector, which must be located on said axis near the largest diameter of the lamp vessel. This results in a narrower beam having a higher intensity and a larger homogeneity at the centre.

It is favourable for the beam formed by an external reflector if the average distance of elements of the filament from the axis of symmetry is minimized. This object can be achieved in that a polygonal shape is chosen for the filament. However, this has the disadvantage that a complicated construction is required to retain this shape of the filament. Furthermore, each support used to form a kink point in the filament leads to lose in the light output of the lamp due to the fact that it withdraws heat from the filament. The angles through which the filament can be kinked are limited. When the lamp burns for the first time, the filament shrinks. In order to have the same pitch throughout its length after shrinkage, it is necessary that a filament during shrinkage can slide along supports forming the kink points in the filament. In general, a filament is therefore kinked through angles of at least about 115° . In the lamp according to the invention, it is possible nevertheless to give a filament having a given simple shape, a small distance from the axis of symmetry by displacement with respect to the said second plane through the axis, the average distance of elements of which the filament is composed from the axis being minimized.

BRIEF DESCRIPTION OF THE DRAWING

An embodiment of the lamp according to the invention is shown in the drawing. In the drawing.

DESCRIPTION OF THE PREFERRED EMBODIMENT

Figure 1:
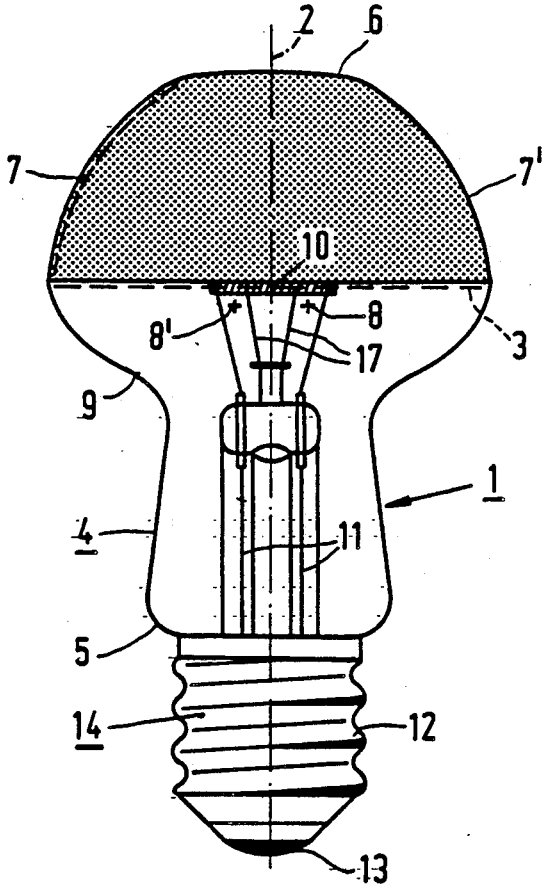
FIG. 1 is a side elevation of a lamp.

In FIG. 1, the electric incandescent lamp has a rotation-symmetrical blown glass lamp vessel 1 sealed in a vacuum-tight manner and having an axis of symmetry 2 and a largest diameter 3 transverse to said axis. The lamp vessel 1 has a neck-shaped first wall portion 4 having a free end 5, a second wall portion 6 opposite to the neck-shaped wall portion having a transverse dimension substantially corresponding to the smallest transverse dimension of the neck-shaped wall portion and a third mirror-coated inner concave wall portion 7, 7' between the second wall portion 6 and the largest diameter 3. This third mirror-coated wall portion 7, 7' is mainly curved in axial section along the arc of a circle, whose centre of curvature 8, 8' is located on a circle. The lamp vessel 1 further has a fourth translucent wall portion 9 between the neck-shaped portion 4 and the largest diameter 3. The filament 10 is arranged around the axis of symmetry 2 substantially in a plane transverse to said axis 2, substantially at the largest diameter 3. Current supply conductors 11 extend from the filament 10 to contacts 12, 13 on a lamp cap 14 connected to the free end 5 of the neck-shaped wall portion 4.

At the third mirror-coated wall portion 7, 7', the centre of curvature 8 and 8', respectively, and the associated arc 7 and 7', respectively, are located on opposite sides of the axis of symmetry 2 and of a plane passing through the largest diameter 3. The axis of symmetry 2 and the largest diameter 3 are both located between the wall portion and the centre of curvature 8 of said wall portion. The filament 10 (FIG. 2) has a plane of symmetry 15, which at least substantially coincides with a first plane through the axis of symmetry 2 and extends on either side of a second plane 16 through said axis 2 at right angles to the first plane. In FIG. 1, the second wall portion 6 has a flattended shape and is also mirror-coated, but in another embodiment it is not mirror-coated or is mirror-coated only at its circumference so that a window is present, through which light is irradiated within a narrow angle with the axis 2. The wall portion 6 may alternatively be spherical or conical.

The filament 10 (FIG. 2) has the shape of an equilateral trapeze with open base. The adjacent portions of the filament enclose an angle of about 117° with each other. Besides the current supply conductors 11, the filament 10 needs because of its simple shape only two supports 17 to be held in its position. With a view to the shape shown in FIG. 2 of the filament 10, the filament is positioned so that the average distance of its elements 10' from the axis of symmetry 2 is minimized. The filament 10 consequently has a central position. For the filament shown, the minimum distance from the axis is about 1.6 mm. The circular collection of centres of curvatures 8, 8' is indicated by the circle 8, 8'.

Figure 2:
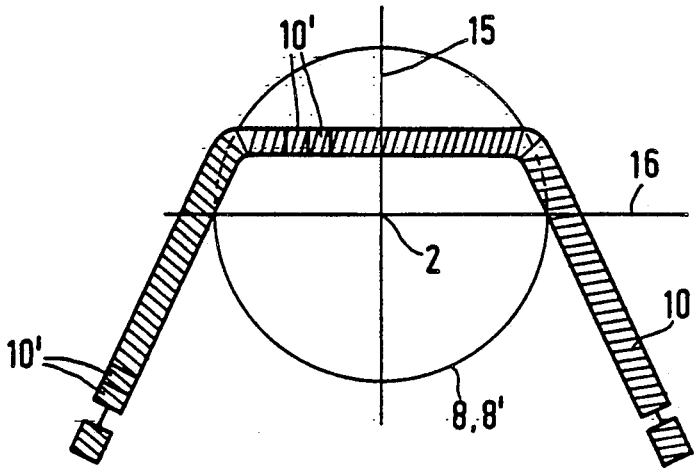
FIG. 2 is a front elevation of the filament of the lamp of FIG. 1.

Lamps according to the invention of the shape shown in FIG. 1 having a filament of the shape and in the position shown in FIG. 2 had a largest diameter of 60 mm and consumed a power of 60 W. They were operated in a parabolic reflector having a diameter of 150 mm. For comparison, commercially available lamps of 60 W provided with a spherical bowl mirror having a diameter of 60 mm, were operated in the same reflector. The luminous flux of the beams formed along their axis (Io) as well as the width of the beams are measured. The width of the beam is found in that the directions are determined in which the light current is equal to 0.5 Io. Further, the quality of the luminous spot formed on a screen was judged and the life of the lamp was determined. The measurement results are indicated in Table I.

TABLE I

| | Io (kcd) | width (degrees) |
|---|---|---|
| Lamps acc. to the inv. | 8–10 | 2 × 5.5. |
| Lamps comm. available | 3.5–3.5 | 2 × 6.5. |

In both types of lamps, a spread in the Io was measured. However, it appears from Table I that the lamps according to the invention produce a considerably stronger and narrower beam than the commercially available lamps. The lamps according to the invention produce a homogeneous luminous spot; the commercially available lamps produce an inhomogeneous luminous spot with a dark centre. The life of both lamp types is nominally 1000 hours.

I claim:

1. An electric incandescent lamp comprising:

a rotation-symmetrical blown lamp vessel sealed in a vacuum-tight manner and provided with:

an axis of symmetry;

a largest diameter transverse to the axis of symmetry;

a neck-shaped first wall portion having a free end;

a second wall portion opposite to the neck-shaped wall portion;

a third mirror-coated inner concave wall portion between the second wall portion and the largest diameter, which wall portion is mainly curved in axial section along the arc of a circle, whose centre of curvature is located on a circle;

a fourth translucent wall portion between the neck-shaped wall portion and the largest diameter;

a filament arranged around the axis of symmetry substantially in a plane transverse to said axis, substantially at the largest diameter;

current supply conductors extending from the filament to contacts on a lamp cap connected to the free end of the neck-shaped wall portion, characterized in that at the third mirror-coated wall portion, the centre of curvature and the associated arc are located on opposite sides of the axis of symmetry and of a plane passing through the largest diameter, and the filament has a plane of symmetry which substantially coincides with a first plane through the axis of symmetry, while the filament extends on opposite sides of a second plane through said axis at right angles to the first plane.

2. An electric incandescent lamp as claimed in claim 1, characterized in that with a chosen shape of the filament the average distance from the axis of symmetry of elements of which the filament is composed is a minimum.

3. An electric incandescent lamp as claimed in claim 1, characterized in that a substantial portion of the filament is disposed closer to the axis of symmetry than is the circle on which said center of curvature is located.

* * * * *